United States Patent [19]

Brown et al.

[11] 4,026,593

[45] May 31, 1977

[54] QUICK FIND GRABBER-MINE RECOVERY

[75] Inventors: Wallace E. Brown, Del Mar; James G. Proctor; William H. Armstrong, both of San Diego, all of Calif.

[73] Assignee: The United States of America as represented by the Secretary of the Navy, Washington, D.C.

[22] Filed: Sept. 2, 1976

[21] Appl. No.: 720,036

[52] U.S. Cl. ..... 294/66 R; 294/110 R

[51] Int. Cl.[2] ..... B66C 1/42

[58] Field of Search ..... 294/66 R, 86 R, 104, 294/106, 110 R, 113, 118

[56] References Cited

UNITED STATES PATENTS

| | | | |
|---|---|---|---|
| 900,889 | 10/1908 | Schuster | 294/110 R X |
| 1,008,724 | 11/1911 | Lenderman | 294/110 R |
| 3,479,078 | 11/1969 | Doty | 294/104 |
| 3,722,941 | 3/1973 | Seiple et al. | 294/66 R |

*Primary Examiner*—Johnny D. Cherry

*Attorney, Agent, or Firm*—Richard S. Sciascia; Ervin F. Johnston; Thomas Glenn Keough

[57] ABSTRACT

A grabber having a pair of ice tong-like arcuate members is carried to the ocean depths by a marine mammal to secure a hoisting line to an object on the bottom. A trigger mechanism is located on the grabber to assure precise positioning on and reliable engagement of the object.

8 Claims, 6 Drawing Figures

QUICK FIND GRABBER-MINE RECOVERY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Devices for recovering underwater objects, such as practice mines and torpedos, have undergone a sophisticated evolution. Generally, divers no longer need to grope about in cold, murky, deep water to affix hoisting lines to the expended devices. Marine mammals have shown an unusual ability for performing such tasks due to their improved eyesight, better respiratory cycles, and a variety of other reasons. Trainers have found after a short period of time that animals can be trained to locate a sunken device by homing-in on a source of sound carried on expended practice ordinance. When they got close enough to see it, they would attach the recovery device and a retrieval line. The grabber disclosed in U.S. Pat. No. 3,722,941 issued to Ronald L. Seiple and entitle "Marine Mammal Underwater Attachment and Recovery Tool" served quite well during the recovery of a lightweight breed of practice torpedoes, however, care needed to be exercised in handling or the mechanism might become mechanically disabled. Reliable engagement was assured unless it was aligned nearly perfectly. Marine sediment created problems and the recovery of ordinance partially buried in the ocean floor was difficult. Various other mechanisms have been designed with a greater weight lifting capability but they tend to be unduly complicated or too large for deployment by marine mammals. None of the known devices avail themselves of the mechanically proven ice tong principal released by a straight forward triggering device to engage an object and to grip heavier objects harder to further assure their recovery. Thus, there is a continuing need in the state-of-the-art for a highly reliable functional recovery device deployable to great depths by marine mammals.

SUMMARY OF THE INVENTION

The present invention is directed to providing an improved apparatus actuated by a marine mammal for connecting a line to a submerged object. A pair of ice tong-like arcuate members are journaled together to relative converging pivotal motion and a nose cup is centrally disposed on the arcuate members. A single spring tends to urge the arcuate members together, yet, such converging motion is retained by a trigger mechanism laterally aligned with the nose cup. A sear in the trigger mechanism is displaced when a trigger is brought in contact with the object. This displacement lets the biasing spring push the sharpened tips of the arcuate members together about the object. The lifting force exerted by a hoisting line increases the gripping force on the object thereby assuring the recovery of heavy objects.

It is an object of the invention to providean improved apparatus for recovering objects from ocean depths.

Yet another object is to provide an improved recovery device deployable by marine mammals.

Still another object is to provide the recovery device fabricated from a pair of ice tong-like arcuate members actuated by an uncomplicated trigger mechanism.

Still another object of the invention is to provide a recovery device which exerts an increased converging force proportional to the weight of the object being recovered.

Still another object of the invention is to provide an object recovering device having sharpened elements which assure a penetrating engagement of the object.

These and other objects of the invention will become more readily apparent from the ensuing specification when taken together with the drawings.

DESCRIPTION OF THE PREFERRED EMBODIMENTS

Figure 1:
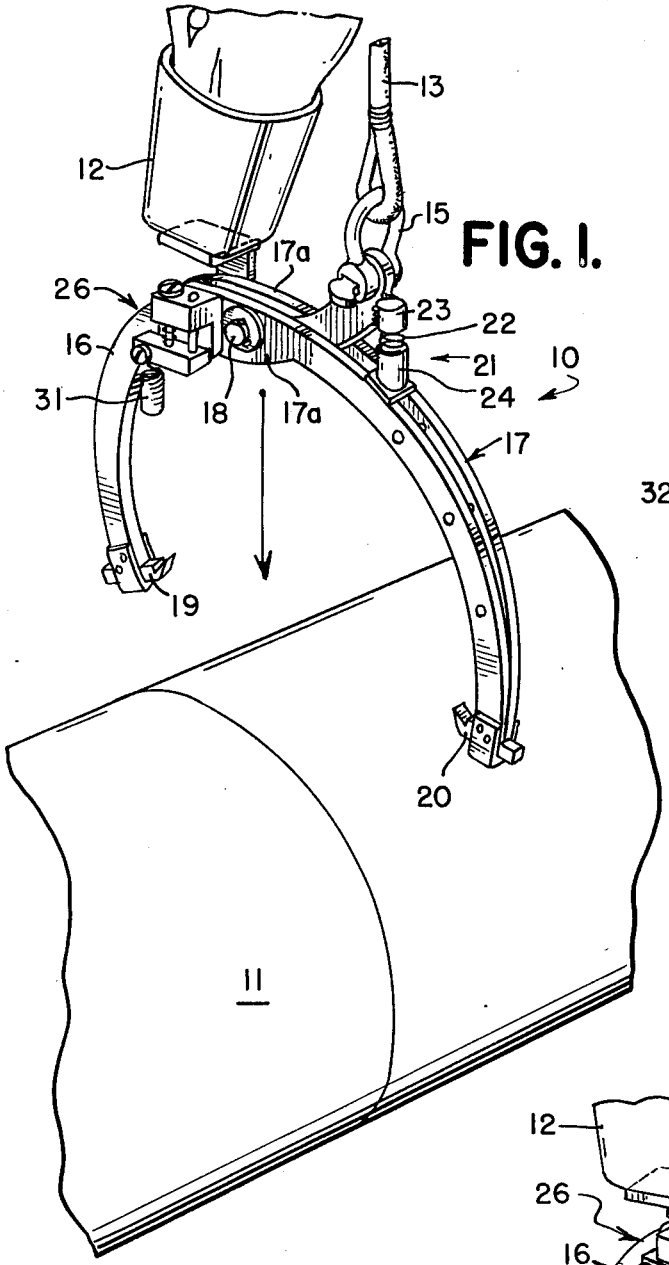
FIG. 1 is an isometric view depicting a marine mammal about to engage the grabber on a submerged object.
Figure 3:
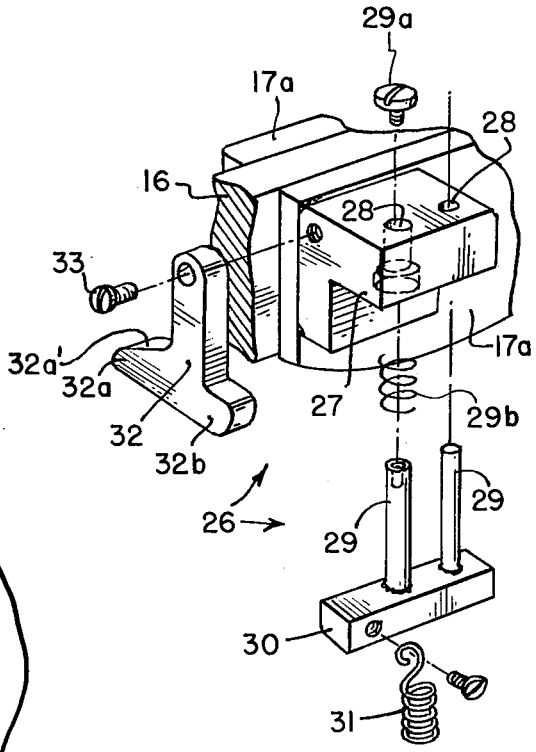
FIG. 3 is an isometric exploded view of the trigger mechanism.
Figure 2:
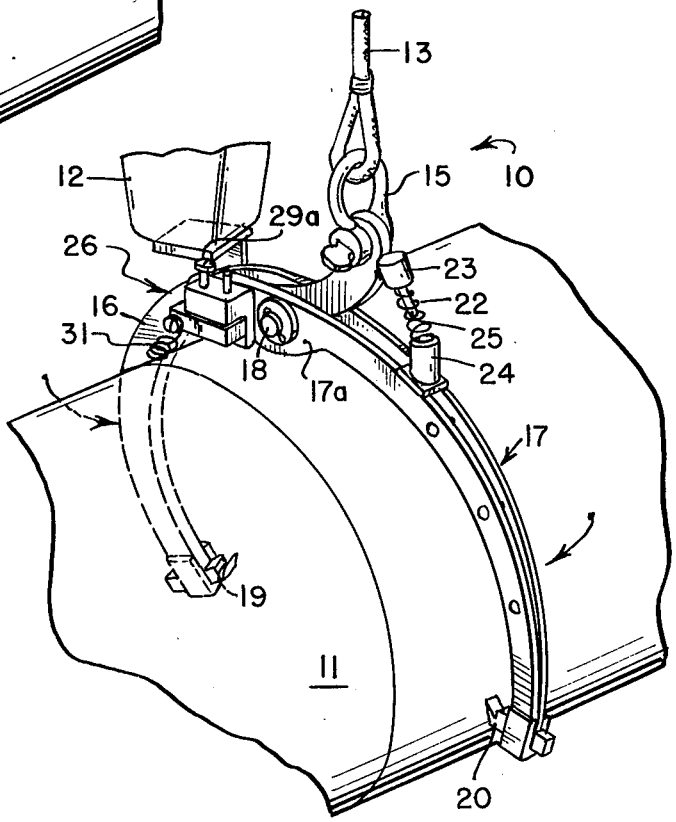
FIG. 2 is an isometric view showing the grabber engaged on an object.
Figure 4:
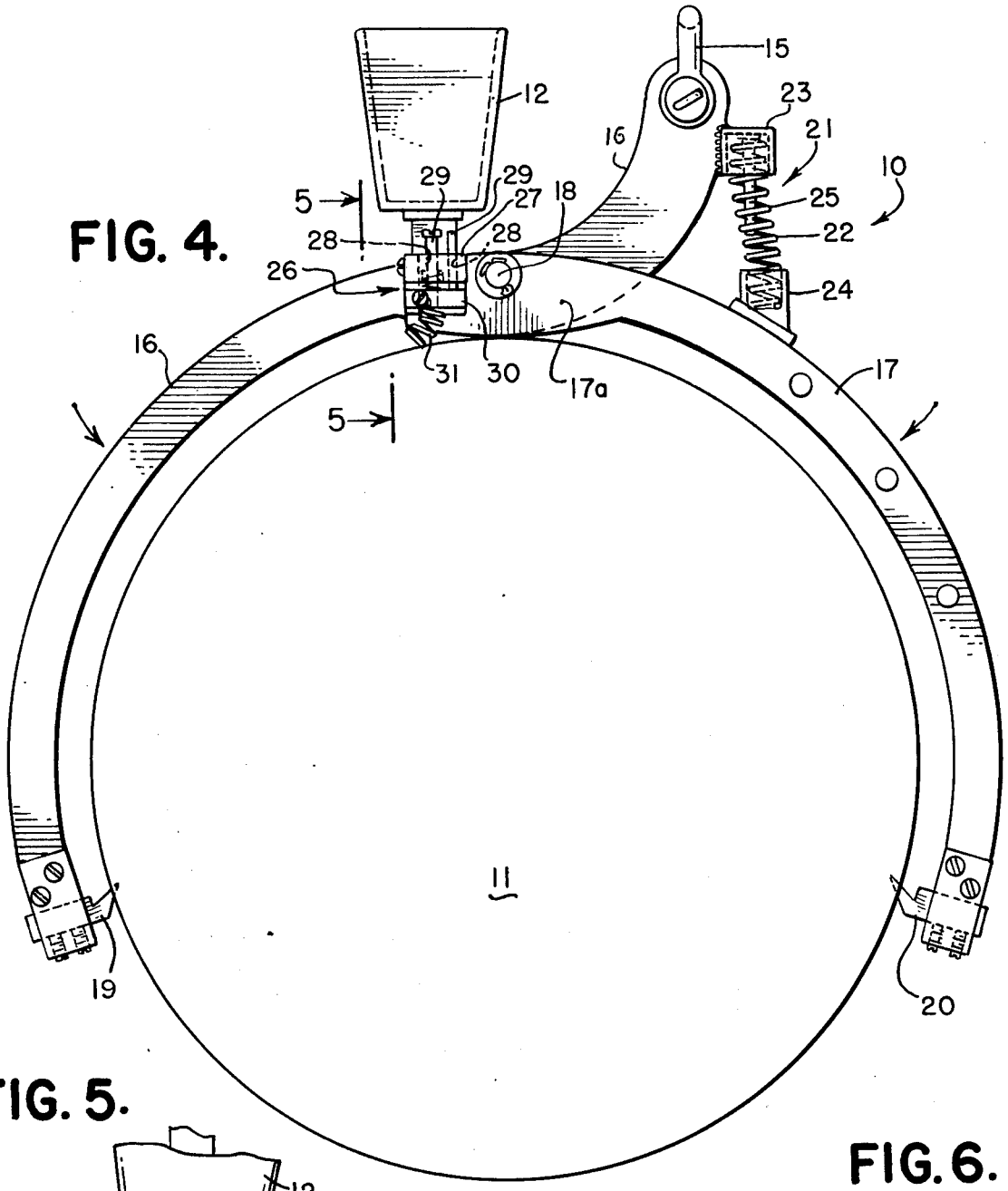
FIG. 4 is a side view of the grabber engaging an object.
Figure 5:
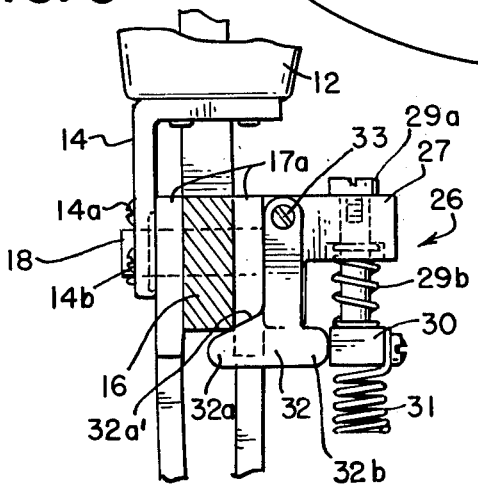
FIG. 5 is a view taken generally along lines 5–5 in FIG. 4 showing the trigger mechanism in the latched position.
Figure 6:
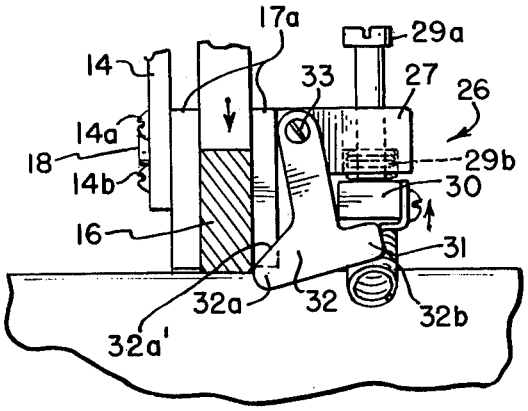
FIG. 6 is a view of the trigger mechanism taken generally along lines 5–5 in FIG. 4 depicting it in the released position.

Referring now to the drawings, a grabber 10 is designed to recover an object 11 such as practice torpedoes or mines from the ocean floor. Recovery of such objects for reuse has resulted in a considerable savings and has made possible more extensive training programs.

A nose cup 12 is shaped to accommodate the muzzle of a marine mammal, such as a sea lion. A bracket 14 is bolted via bolts **14*a* and 14*b*** to other elements of the grabber. The nose cup and bracket's configuration greatly aids deployment for it enables the sea lions to see the object and position the grabber in the proper orientation for engagement. Furthermore, the nose cup and bracket are essentially laterally in-line with other mechanisms to be discussed below to further assure a precise alignment and placement of the grabber.

Once an object has been engaged, the animal simply withdraws, pulls free of the nose cup and returns to the surface. Tension on a hoisting line 13 looped through a clevis 15 aids in tightening the gripping force on the object and permits retrieval of the object by a surface vessel.

An arcuate member 16 is pivotally mounted to another arcuately-shaped member 17 by an axis pin 18. A U-shaped end portion **17*a* of the member 17 embraces an end portion of member 16.** Thusly arranged, the two members resemble and functionally cooperate in much the same manner as an ice tong.

At opposite ends of each of the arcuate members sharp points 19 and 20 are mounted to extend substantially perpendicularly inwardly from the arcuate members. They are so oriented to securely penetratingly engage an object during its recovery. Fashioning the points from a hard tough material such as tungsten carbide, assures a penetrating engagement and recovery of the object.

The two arcuate shaped members are urged toward pivotal converging motion by a biasing assembly 21 mounted between the two arcuately shaped members. A normally compressed biasing spring 22 is held between a cup shaped retainer 23 on member 16 and a cup shaped retainer 24 mounted on arcuate member 17. A coaxially disposed guide rod 25 helps to prevent buckling or escape of the biasing spring as the arcuate members rotate about the axis pin.

A trigger mechanisim 26 has a mounting block 27 bolted, welded or otherwise suitably affixed to the distal end of U-shaped end portion 17*a*. The mounting block is provided with a pair of traverse bores 28 which slidably retain a pair of push rods 29.

Both push rods are secured to a sear release 30 which extends beyond the length of the mounting block. Since the push rods, are slightly smaller than the traverse bores, a push rod retainer screw 29*a* is provided in at least one of the push rods to keep them from falling out. The retainer screw also serves to contain the force exerted by a small spring 29*b* which holds the sear release away from the mounting block. Reciprocable motion of the sear release is imparted when a trigger spring 31 is pressed against and released from the surface of object 11. This occurs when the marine mammal pushes the grabber's trigger spring on the object.

A pivoted sear 32 having an essentially T-shaped configuration is pivotally mounted by a pin 33 reaching through its stem to the mounting block 27. When a projection 32*a* of the cross member of the T-shaped sear engages arcuate shaped member 16, the sear release 30 prevents pivotal motion of the pivoted sear and constrains the biasing force exerted by biasing spring 22. However, when trigger spring 31 is pressed against an object 11, push rods 29 and sear release 30 are reciprocably displaced. This removes the sear release from its abutting position on projection 32*b* of the cross member of the T-shaped pivoted sear. A camming surface 32*a* ' on projection 32*a* reacts with the force exerted by biasing spring 22 via member 16 and the projection moves from the path of member 16. This reciprocal motion is no longer held against arcuate members 16 and 17 and biasing spring 22 is free to rotate the members toward each other. The arcuately shaped members reach around the object, tips 19 and 20 make a slight penetrating engagement, and it may be lifted to surface. The heavier the object is, the harder the two tips dig into it to assure its recovery.

Fashioning the entire assembly from aluminum makes it light enough for the marine mammal. The lateral alignment of the nose cup, trigger mechanism, and trigger spring promotes accurate placement. The chances for recovery of the object are increased since the grabber increases its gripping force as the object is raised.

Obviously, many modifications and variations of the present invention are possible in the light of the above teachings, and, it is therefore understood that within the scope of the disclosed inventive concept, the invention may be practiced otherwise than as specifically described.

What is claimed is:

1. In an apparatus actuated by a marine mammal for connecting a line to a submerged object and having a pair of ice tong-like arcuate members journaled together for relative converging pivotal motion, an improvement therefor is provided comprising:

means shaped to fit on the head of the marine mammal and being carried thereon for aligning the arcuate members with the object;

means mounted between first end portions of the pair of ice tong-like arcuate members for biasing their second opposite end portions in a pivotally converging direction;

means carried on the first end portion of one of the ice tong-like arcuate members disposed in a substantially lateral alignment with the arcuate members for retaining the second opposite end portions of the ice tong-like arcuate members from pivotally converging motion;

means mounted in a substantially lateral alignment with the arcuate members and retaining means for releasing the retaining means to allow the pivotally converging motion about the object;

means carried on the second opposite portions of the pair of ice tong-like arcuate members for penetratingly engaging the object; and means coupling the line to only one first end portion of one of the ice tong-like arcuate members to ensure penetrating engagement with the object.

2. An apparatus according to claim 1 in which the retaining means is an essentially T-shaped sear member having its stem pivotally mounted on a first end portion of one of the ice tong-like arcuate members and a first end of the cross portion of the T-shaped sear member contacts the other first end portion of the ice tong-like arcuate member.

3. An apparatus according to claim 2 in which the releasing means includes a sear release adapted for reciprocal motion from a position pivotally aligned with the opposite end of the cross portion of the T-shaped sear member to a position of non-alignment with the opposite end of the cross portion of the T-shaped sear member thereby allowing pivotally converging motion about the object.

4. An apparatus according to claim 3 in which the first end of the cross portion of the T-shaped sear member is provided with a camming surface disposed to be pivotally displaced from contacting the other first end portion of the ice tong-like arcuate member when the sear release is moved to a position of non-alignment with the opposite end of the cross portion of the T-shaped sear member.

5. An apparatus according to claim 4 in which the releasing means further includes a pair of push rods connected to the sear release to ensure the reciprocal motion by the sear release from its position pivotally aligned with the opposite end of the cross portion of the T-shaped sear member.

6. An apparatus according to claim 5 in which the releasing means further includes a resilient trigger connected to the sear release to permit pivotally converging motion by the pair of ice tong-like arcuate members when the resilient trigger contacts and is displaced by the object.

7. An apparatus according to claim 6 in which the penetratingly engaging means is a pair of sharpened tungsten carbide points for engaging the object.

8. An apparatus according to claim 7 in which the pair of ice tong-like arcuate members are fashioned from aluminum to facilitate deployment by the marine mammal.

* * * * *